US005533948A

United States Patent [19]

Wilkinson

[11] Patent Number: 5,533,948

[45] Date of Patent: Jul. 9, 1996

[54] COMBINATION EXERCISE DEVICE

[76] Inventor: William T. Wilkinson, Severnside Farm, 300 Kyle Rd., Crownsville, Md. 21032-0572

[21] Appl. No.: 151,957

[22] Filed: Nov. 15, 1993

Related U.S. Application Data

[63] Continuation-in-part of Ser. No. 986,487, Dec. 7, 1992, abandoned, and a continuation-in-part of Ser. No. 55,750, May 3, 1993, abandoned, and a continuation-in-part of Ser. No. 56,930, May 5, 1993, Pat. No. 5,284,461.

[51] Int. Cl.[6] ..... A63B 21/08

[52] U.S. Cl. ..... 482/27; 482/51; 482/52; 482/146

[58] Field of Search ..... 482/51, 52, 146, 482/147; 2/27, 29, 114, 118, 70, 72, 28, 52, 118, 124

[56] References Cited

U.S. PATENT DOCUMENTS 2,324,970 7/1943 Woolley ..... 482/27

5,074,550 12/1991 Sloan ..... 482/27

FOREIGN PATENT DOCUMENTS 2657528 8/1991 France ..... 482/27

*Primary Examiner*—Jerome Donnelly
*Attorney, Agent, or Firm*—Connolly & Hutz

[57] ABSTRACT

A combination exercise device includes a trampoline which has a peripheral frame and a resiliently mounted spring member secured to the frame with an upper surface upon which the user may jump. Feet are mounted to the frame for elevating the spring member. The exercise device also includes a step which has a horizontal rigid platform upon which the user may be repeatedly step on and off in an aerobic exercise. The step is mounted with its platform over at least a portion of the spring member so that the user may selectively use the exercise device in a trampoline and/or stepping exercise mode.

20 Claims, 4 Drawing Sheets

Fig. 14.
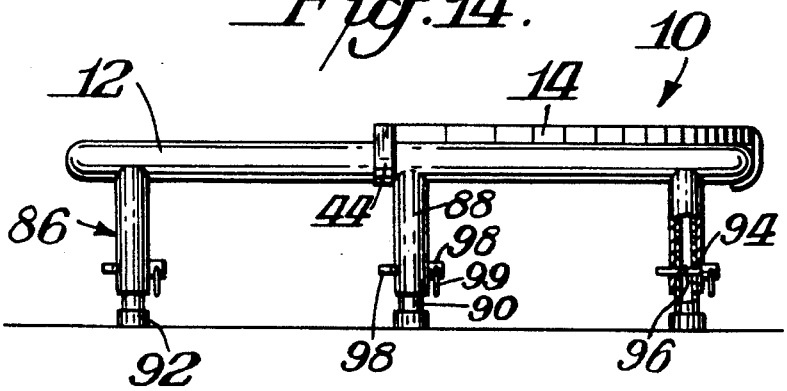
Fig. 15.
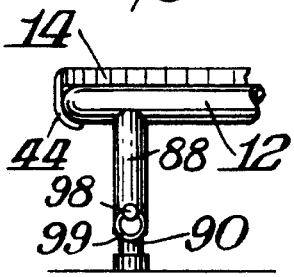
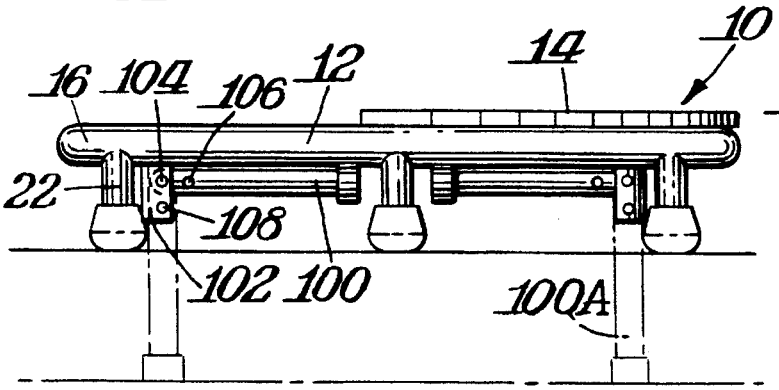
Fig. 16.
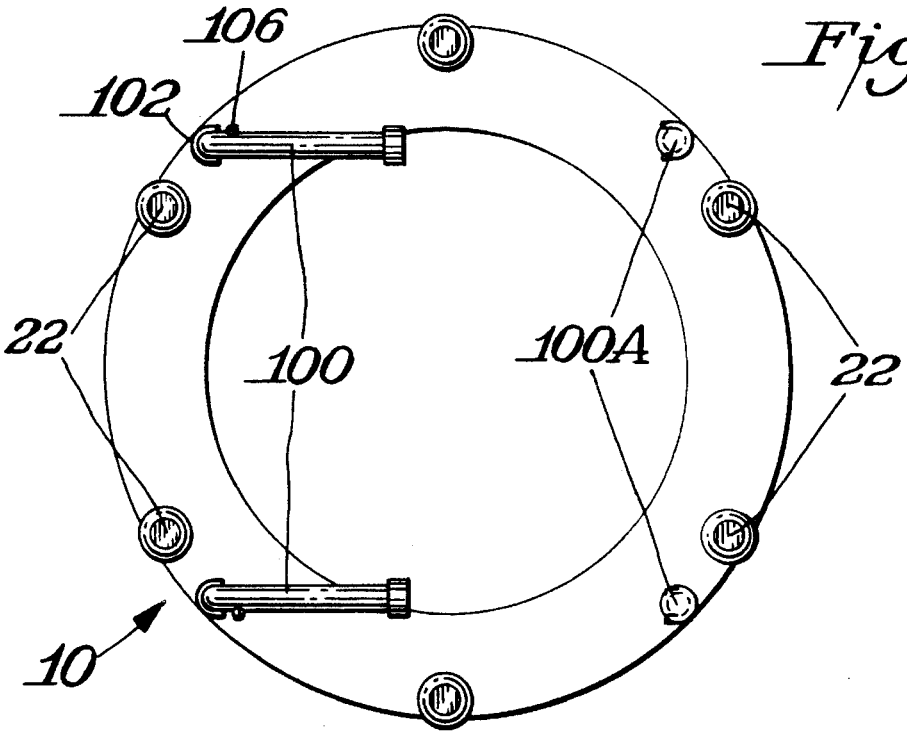
Fig. 17.

COMBINATION EXERCISE DEVICE

CROSS-REFERENCE TO RELATED APPLICATIONS

This application is a continuation in part of application Ser. Nos. 07/986,487, now abandoned filed Dec. 7, 1992; 08/055,750, now abandoned filed May 3, 1993; and 08/056,930, now issued U.S. Pat. No. 5,284,461 filed May 5, 1993. Ser. No. 08/055,750 is a continuation in part of application Ser. No. 07/945,373, filed Dec. 16, 1992 U.S. Pat. No. 5,207,622.

BACKGROUND OF THE INVENTION

Exercise devices have been increasing in popularity. Various forms of exercise devices are known. Various forms of combining exercise devices are also known. Two popular exercise devices are trampolines and aerobic steps. Heretofore, however, these devices have not been combined into a single exercise unit. It would be desirable if such a unit could be provided to permit a user to selectively perform a trampoline exercise and/or an aerobic step exercise.

SUMMARY OF THE INVENTION

An object of this invention is to provide a combination exercise device which incorporates a trampoline and an aerobic step in the same unit.

A further object of this invention is to provide such an exercise device which may include further forms of exercise, such as a rotating disc and upper body exercise poles.

In accordance with this invention a combination exercise device comprises a trampoline and an aerobic step. The trampoline has a peripheral frame with a resiliently mounted spring member secured to the frame. The spring member has an upper surface upon which the user may jump. Feet are mounted to the frame for elevating the spring member. The step has a horizontal rigid platform which is mounted over at least a portion of the spring member so that the user may selectively use the device in a trampoline and/or stepping exercise mode.

The invention may be practiced by having adjustable feet on the step for elevating the step independently of the trampoline. Similarly, the trampoline may have adjustable feet. The step could be placed directly on and supported by the trampoline frame to elevate the step when the trampoline is elevated. Alternatively the step may be straddled over the trampoline without being supported by the trampoline.

A twister disc may be mounted on the step. In one form of this invention the twister disc may be removably mounted. Alternatively, the twister disc may be permanently mounted on the step by being located in a recess in the step so that the upper surface of the twister disc is coplanar with the remaining upper surface of the step platform. Means could be provided for locking the twister disc against rotation when it is desired to use the step only as a step.

The invention may also be practiced by mounting pivoted poles to the trampoline frame or to the step for providing an upper body exercise.

THE DRAWINGS

FIG. 14 is a side elevational view of yet another form of combination exercise device in accordance with this invention;

FIG. 15 is a fragmental end elevational view of the device shown in FIG. 14;

FIG. 16 is a side elevational view of still yet another combination exercise device in accordance with this invention; and FIG. 17 is a bottom plan view of the device shown in FIG. 16.

DETAILED DESCRIPTION

Figure 2:
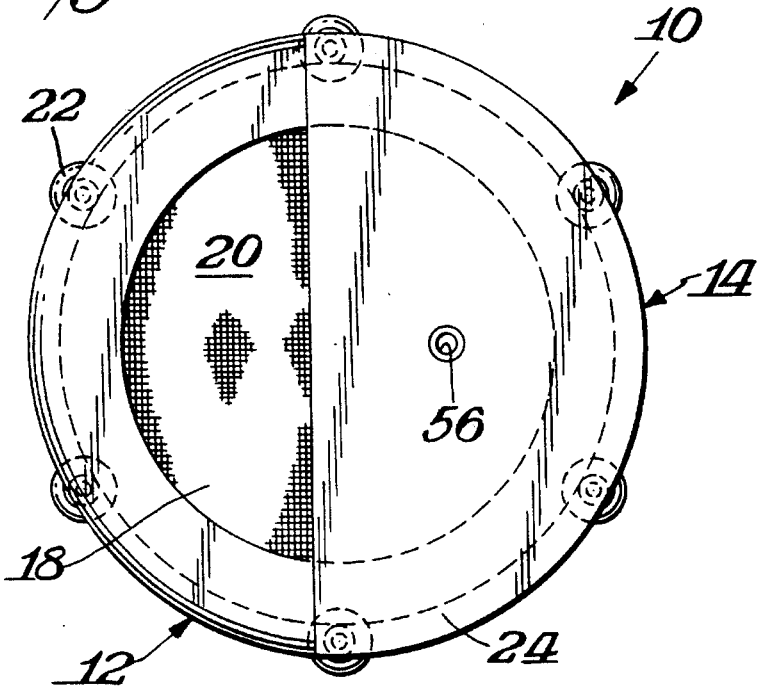
FIG. 2 is a top plan view of the device shown in FIG. 1.

In general, the invention comprises a combination exercise device which includes a trampoline and an aerobic step. This is done by including a platform that could be placed over all or part of the trampoline spring member to convert the trampoline to an aerobic step. In the preferred practice of the invention, means are provided to vary the height of the platform either by adjustable feet on the step or by adjustable feet on the trampoline itself or by adjustable feet on both the trampoline and the step.

Either the trampoline or the step may have pivoted resistance arms or poles for balance and/or upper body exercise. Additionally, a circular rotatable disc may be included in the device for permitting a twisting exercise. Preferably the disc would be placed on top of the step, although it could be placed on the trampoline by being mounted to the trampoline frame.

Thus, the invention can deliver both upper and lower body exercise in as many as three different forms, trampolining, stepping and twisting.

In a preferred practice of this invention the height adjustability to the trampoline could be accomplished in various ways including telescopic feet or the addition of feet or risers. Preferably, however, reversible feet are used to elevate the trampoline two inches in one position of the feet and four inches in the reverse position.

The aerobic platform of the step can also be of any shape such as circular, semi-circular, rectangular or square and would be shaped to match the most common forms of trampolines and particularly the specific portion of trampoline over which it is to be mounted. The aerobic step may be stored during non-use including being stored under the trampoline as long as it is being stored below the spring member of the trampoline a sufficient distance so as to not interfere with its springiness.

The rotating disc for the twisting exercise could be either permanently or removably built into the step. Where the disc is permanently mounted to the step it is preferred to include a means of locking the disc in a fixed position during non-use so that the disc could be used as part of the stepping surface. In this practice, the disc would be an insert into the platform and the top surface of the step platform would be flush with the top surface of the step. Alternatively, the step/platform has a hole and the disc has a center mounting post underneath so that the disc is placed on top of the step into the hole and thus is removable.

The step can be permanently attached to the trampoline or can be detachable. In a practice of the invention using a permanent mounting, the step would only partially cover the trampoline spring member surface so that in essence the resultant device would be a hybrid, part trampoline and part step. The platform or step could also be permanently attached to the trampoline frame by a hinge mechanism that allows the step to flip over on top of the trampoline and be locked in place when it is desired to use a stepping exercise or to be pivoted to a position away from the trampoline spring member when it is desired to use only the trampoline exercise.

The step, when detachable, could be attached to the trampoline in any suitable manner such as by tracks and grooves, posts and holes, interlocking pressure fit, clips, clamps, etc. Alternatively, the step could be shaped and sized so as to straddle over the trampoline with the feet of the step on the floor. The feet of the step could elevate the step a sufficient distance so that there is no contact between the step and the trampoline or the step could be elevated a sufficient distance so that the feet touch the floor and the platform rests on the frame of the trampoline.

In the preferred practice of the invention, the step is a semi-circle or rectangle or square that drops over the top of the trampoline. The frame of the trampoline would have holes to receive posts underneath the step. The step is then secured by the force of gravity when stepping on the step platform.

In a practice of the invention wherein poles or arms are pivotally mounted to the step or trampoline, the purpose of the poles or arms would be to provide balance and total body arm exercise which is achieved particularly where the device also includes a twister and secondarily to provide a total body trampoline exercise.

The twisting disc can be mounted on top of the step for twisting when desired or stored underneath the step or underneath the trampoline. The poles can be mounted to the step or to the trampoline and can be mounted either permanently or detachably.

The poles could use an adjustable friction/resistance mechanism and can be attached or detached in any number of ways. Similarly, the poles can be placed at any suitable location. The poles can be separate units or a single unit with both arms joined together by a shaft or center member forming a generally Y-shape with the center member mounted to the friction mechanism. The poles can be locked in a stationary position when used only for balance or when not in use at all. The poles can be either detached or folded all the way down during periods of non-use. If desired, the poles can freely pivot without a resistance mechanism.

The legs on the trampoline could be hinged to be pivoted to a more flat condition and provide better storage. Similarly, any of the elements of the device which extend outwardly could be hinged or detached to be put in a flat condition during storage and transportation.

The invention is thus primarily a type of trampoline that can be modified to become an aerobic step and/or a twister with the possibility of providing upper body exercise by the inclusion of pivoted poles.

The various figures illustrate preferred practices of this invention. Details of the trampoline and the poles and the twisters may be found in application Ser. Nos. 07/986,487, filed Dec. 7, 1992; 08/056,930, filed May 5, 1993; and 08/055,750, filed May 3, 1993, the details of which are incorporated therein by reference thereto.

Figure 1:
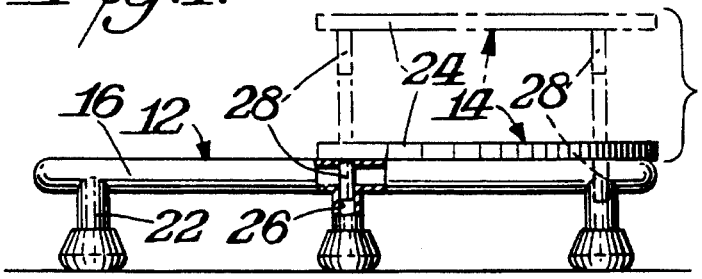
FIG. 1 is a side elevational view of a combination exercise device in accordance with this invention.

FIGS. 1–2 illustrate a combination exercise device 10 in accordance with this invention. As shown therein, device 10 includes a trampoline 12 and a step 14. Trampoline 12 has a peripheral frame 16 with a resiliently mounted spring member 18 secured to the frame in a known manner so that a user may jump up and down on the upper surface 20 of the spring member 18 to perform a trampoline exercise. Frame 16 includes a plurality of feet 22 for elevating the spring member 18 so as to permit the spring member to stretch below the frame during the jumping exercise. In the embodiment shown in FIGS. 1–2 the feet 22 are permanently and non-adjustably mounted to frame 16.

In the embodiment of FIGS. 1–2 the step 14 has a horizontal rigid platform 24 upon which the user may repeatedly step on and off during an aerobic exercise. The platform is mounted to frame 16 in any suitable manner. In the form illustrated in FIGS. 1–2 the mounting is achieved by providing holes 26 in frame 16 which extend into selected feet 22. The holes receive posts 28 which extend downwardly from platform 24. Thus, the step 14 may be conveniently mounted to trampoline 12 by simply placing the posts 28 into the holes 26 and the step would be securely mounted under the force of gravity.

Figure 5:
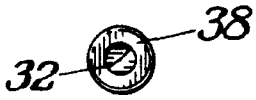
FIG. 5 is a top plan view of the foot shown in FIG.
Figure 4:
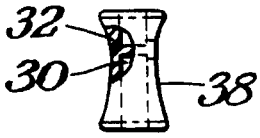
FIG. 4 is a side elevational view partly in section of a foot used in the exercise device of FIG. 3.
Figure 3:
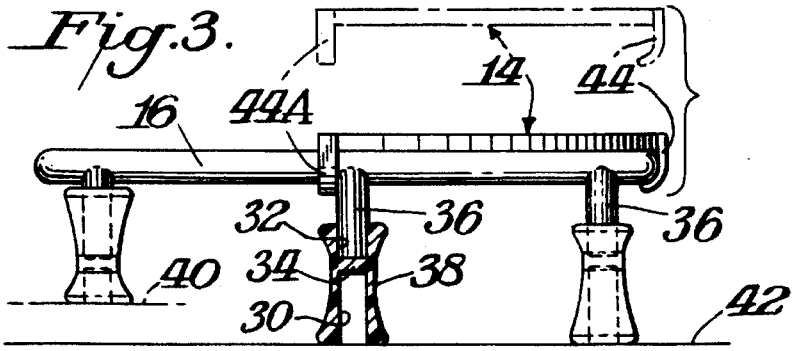
FIG. 3 is a side elevational view partly in section of a modified form of combination exercise device in accordance with this invention.

FIGS. 3–5 illustrate a variation of this invention wherein the feet 38 supporting frame 16 are detachable and provide for height adjustability. As shown therein, the feet 38 include a pair of longitudinal openings 30,32 separated by a rigid partition 34. Partition 34 is located off center so that the length of opening 30 is longer than that of opening 32. Frame 16 includes permanent posts 36 which extend downwardly and are shaped to be inserted into feet 38. The height of the trampoline would thus depend upon which of the openings 30,32 the posts 36 are inserted into. In the left hand portion of FIG. 3 the posts 36 are inserted into the longer holes 30 which would result in one elevation where the feet 38 rest upon a support surface 40. Where, however, the posts 36 are inserted into the shorter holes 32, as illsutrated by the center and right hand portions of FIG. 3, a higher elevation would be achieved when the feet 38 rest upon support surface 42. The FIG. 3 embodiment also permits use on a support surface of non-uniform height. Thus, if the support surface has an upstanding shoulder, a shorter height would be used at that location.

The various means of achieving height adjustability for trampoline 12 or for step 14 may include the techniques disclosed in my various patents relating to height adjustable steps.

FIG. 3 also illustrates an alternative manner of mounting step 14 to trampoline 12. As shown therein, platform 24 has depending spring clips 44 which would snap around tubular frame 16. Thus, the clips 44 could be distended or pulled outwardly a sufficient distance to attach around or be detached from frame 16 when it is desired to mount or remove step 14. Clips 44 may be provided at any suitable location. In the practice illustrated in FIG. 3 the end clips 44A are advantageously mounted on a side of respective posts 36 remote from the remaining clips so that the posts act as stop members to prevent any tendency for the platform to slide off frame 16.

Figure 7:
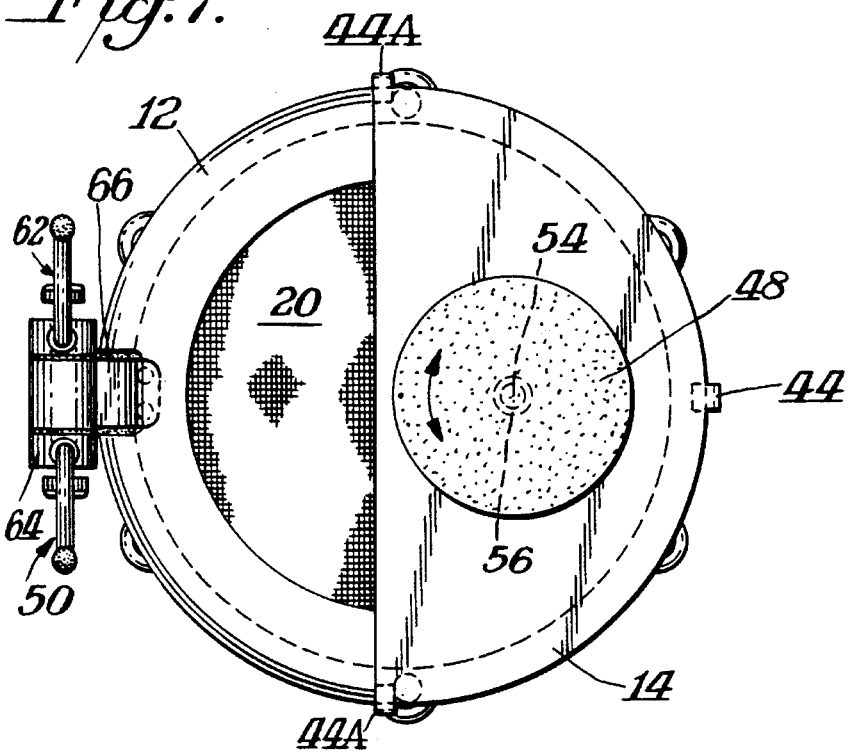
FIG. 7 is a top plan view of the exercise device shown in FIG. 6.
Figure 6:
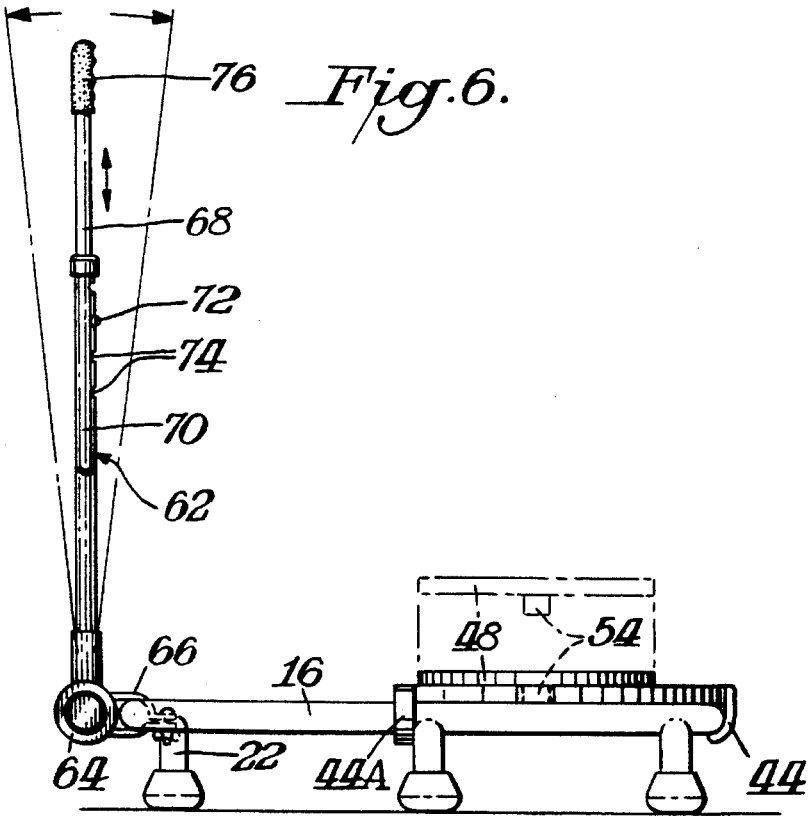
FIG. 6 is a side elevational view of yet another form of combination exercise device in accordance with this invention.

FIGS. 6–7 show alternative forms of device 10 which incorporate a twister 48 and pivoted poles 50. Twister 48 may have the form of construction described in parent application Ser. No. 08/056,930. In general, twister 48 would include a disc 52 having a shaft 54 which would be mounted in a bearing opening 56 (which is also shown in FIG. 2) so that the twister is rotatably mounted on platform 24 of step 14. In this form of the invention, twister 48 is thus detachably mounted to step 14.

Figure 8:
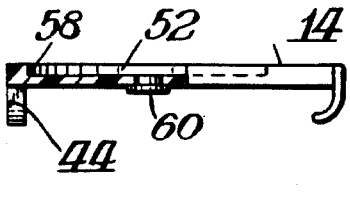
FIG. 8 is a side elevational view partly in section of a modified form of step/twister usable with this invention.

FIG. 8 shows an alternative form of this invention wherein platform 24 includes a recess 58 so as to receive disc 52 with the upper surfaces of disc 52 and platform 24 being coplanar or flush with each other. A suitable locking member 60 is mounted to shaft 54 on the lower surface of platform 24 and is tightened against the lower surface of platform 24 when it is desired to inactivate twister 48. Under such conditions the upper surface of disc 52 would function as part of the platform 24 for use of the aerobic step 14.

FIGS. 7–8 illustrate the pole assembly 50 which may incorporate the features of U.S. Pat. No. 5,207,622 and the parent applications, the details of which are incorporated therein by reference thereto. In general, pole assembly 50 includes a pair of arms or poles 62 which are pivotally mounted on a shaft adjacent frame 16. The mounting includes an adjustable friction mechanism 64 (such as shown in FIG. 6 of U.S. Pat. No. 5,207,622 and a detachable bracket 66 to permit the poles to be detached from frame 16 during periods of non-use. Although not illustrated, poles 62 could be locked in position at any angle and preferably perpendicular to frame 16 when it is desired to use the poles only for balance purposes.

Poles 62 are adjustable in length in any suitable means such as by having an inner member 68 slidably mounted in an outer member 70 with a locking pin 72 on inner member controlling the length in accordance with its extension through a selected one of a row of openings 74. Poles 62 would terminate in handles 76.

It is to be understood that the poles need not be separate members but could be a single unit of generally Y-form where the handles are the ends of the two upward and outward members of the Y and the lower central member of the Y is mounted to the frame and includes the adjustable resistance mechanism. The pole assembly could be detached, by detaching the central member from the shaft on which it is pivotally mounted, leaving the shaft and the resistance mechanism and the bracket mounted to the trampoline frame.

Figure 10:
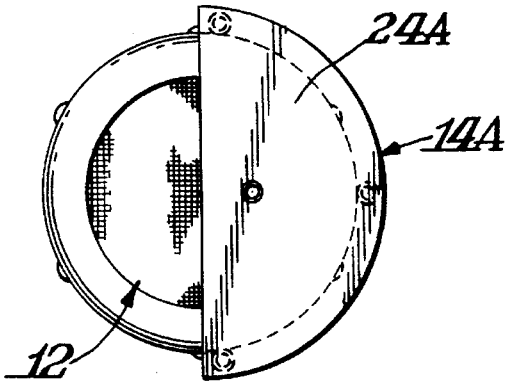
FIG. 10 is a top plan view of the device shown in FIG. 9.
Figure 9:
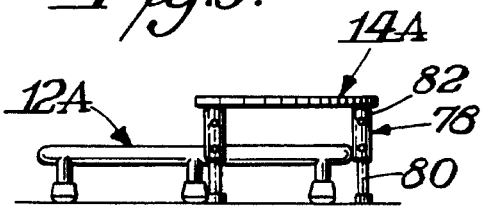
FIG. 9 is a side elevational view of yet another form of combination exercise device in accordance with this invention.

FIGS. 9–10 illustrate another practice of this invention wherein the step 14A is mounted over trampoline 12 without any physical attachment. As shown therein platform 24A would be of a size and shape to completely straddle over a portion of trampoline 12. Step 14A would include its own set of legs 78 which are preferably adjustable in length by, for example, forming each leg 78 as a pair of telescopic members including an inner member 80 and an outer member 82 similar to the length adjustability of poles 62. This embodiment provides the option of lowering the platform 24A until it rests on the trampoline frame.

Figure 12:
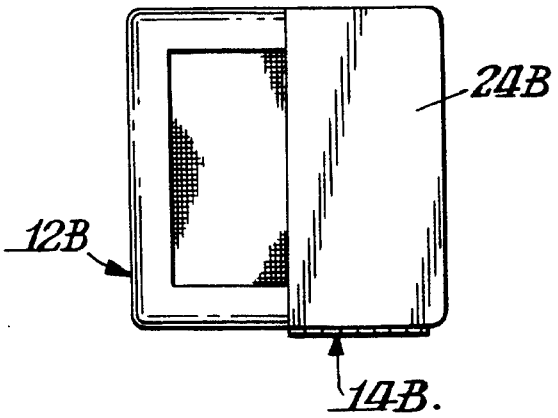
FIG. 12 is a top plan view of the device shown in FIG. 11.
Figure 11:
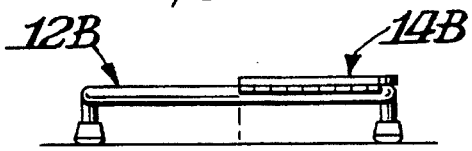
FIG. 11 is an end elevational view of still yet another combination exercise device in accordance with this invention.
Figure 13:
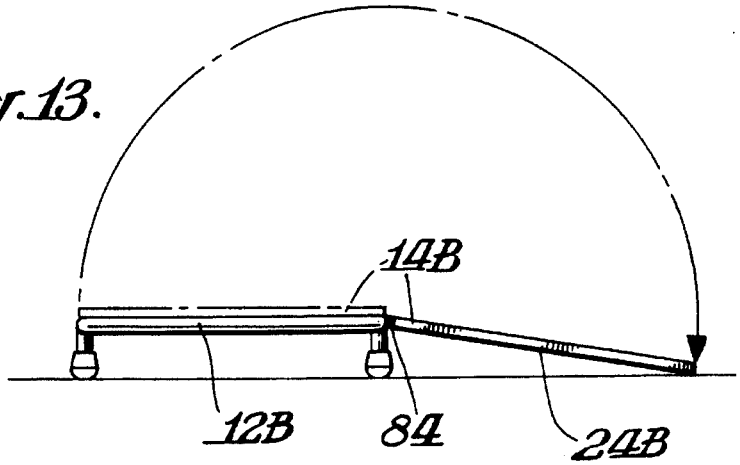
FIG. 13 is a side elevational view of the device shown in FIGS. 11–12 in another phase of operation.

FIGS. 11–13 illustrate still yet another form of this invention wherein the step 14B is hinged to trampoline 12 by a hinge connection 84. Thus, step 14B is permanently mounted to trampoline 12. When it is desired to use only the trampoline, platform 24B would be rotated to the inactive position shown in FIG. 13. When it is desired to use platform 24B as a step, platform 24B would be rotated to the active position shown in FIGS. 11–12.

FIGS. 14–15 illustrate a further practice of this invention. As shown therein device 10 includes a trampoline 12 and a step 14. Step 14 may be mounted to trampoline 12 in any suitable manner such as by the use of clips 44 illustrated in FIG. 3. FIGS. 14–15 illustrate a means of height adjustability wherein the legs 86 are telescopic to achieve this adjustability. Thus, each leg 86 includes an outer tubular member 88 and an inner telescopic tubular member 90 having cushioned feet, such as rubber feet 92. In the illustrated embodiment outer member 88 includes a pair of aligned holes 94 while inner member 90 includes sets of aligned holes 96. When it is desired to fix the elevation of trampoline 12 inner member 90 would be telescoped into outer member 88 the desired distance and positioned so that its appropriate set of aligned holes 96 is aligned with the holes 94 of outer member 88. A detachable pin 98 or other lock member could then be inserted through the various sets of aligned holes to lock the inner and outer members 88,90 in place. As illustrated in FIGS. 14–15 the fastener 98 could include a pull ring 99 to facilitate the removal of the fastener from the sets of holes 94,96.

It is to be understood that any other forms of height adjustability could be utilized including telescopic members, such as the telescopic legs 78 described in FIG. 9 with respect to step 14A.

FIGS. 16–17 show yet another form of height adjustability. As illustrated therein device 10 again would include a step 14 mounted over trampoline 12. Height adjustability is achieved by the selected use of different sets of legs mounted to trampoline 12. For example, one set of legs 22 may be used which is secured to trampoline frame 16 in a fixed or non-movable condition in the manner described with respect to FIG. 1. Other height adjustability could be attained by utilizing one or more different sets of legs which are hingedly connected or otherwise folded against frame 16. FIGS. 16–17, for example, illustrate a second set of legs 100, each of which is mounted to a bracket 102 connected to frame 16. The mounting is by a pivot member 104 so that the legs 100 may be selectively moved from an inactive stored position where they do not extend beyond the lower ends of legs 22 or to a vertical supporting condition illsutrated in phantom in FIG. 16. FIG. 17 illustrates two of the folded legs in solid lines folded against frame 16 with two other legs 100A being in the vertical supported position. It is to be understood that other height adjustments could be achieved by having further sets of legs selectively folded against trampoline 12. Alternatively, the folded legs and/or the fixed legs could be constructed in a telescopic manner similar to legs 86 to provide other height adjustment possibilities. The fixed legs could give a height elevation of, for example, four inches to six inches while the foldable legs could provide height elevation of, for example, six inches to twelve inches.

FIGS. 16–17 further illustrate the inclusion of selective locking means for maintaining the folded legs 100 in their use or supporting condition. As shown therein each leg 100 includes a spring pin 106. Bracket 102 has a detent 108 positioned so that when its respective leg 100 is mounted in the vertical position shown in phantom the corresponding spring pin 106 would enter the detent 108 and lock the leg in place. Bracket 102 is advantageously U-shaped as best shown in FIG. 17 to act as a stop for limiting the amount of pivotal action of leg 100.

It is also noted that FIG. 12 shows the step to have a rectangular shape whereas other Figures show a semi-circular shape. It is to be understood that the invention may be practiced where the trampoline and/or step have any shape provided the shapes are compatible with each other. This could include, for example, having a rectangular shape over a portion of a circular trampoline. It is also to be understood that the invention may be practiced where the step completely covers all of the spring member 18 of the trampoline when it is desired to use the device solely as a step since various Figures such as FIGS. 2, 7, 10 and 12 show the step to cover about one-half of the spring member and since the step could also completely cover all of the spring member or jumping surface the step could be considered as covering about one half of the jumping surface. It is also to be understood that various features shown in the various embodiments may be incorporated in other embodiments of this invention.

What is claimed is:

1. A combination exercise device comprising (a) a trampoline, said trampoline comprising a peripheral frame, a spring member secured by resilient mounting structure to said frame, said spring member being disposed within and spaced from said frame, said spring member having an upper jumping surface upon which a user may jump, feet mounted to said frame for elevating said spring member, and (b) a step, said step having a horizontal rigid platform upon which a user may repeatedly step on and off in an aerobic exercise, and mounting elements mounting said platform to said trampoline directly over about at least one-half of said upper jumping surface of said spring member inwardly of said resilient mounting structure whereby the user may selectively use said device in a trampoline and/or stepping exercise mode.

2. The device of claim 1 including means for adjusting the elevation of said platform.

3. The device of claim 2 wherein said means for adjusting the elevation of said platform comprises said feet which are mounted to said frame being adjustable in height.

4. The device of claim 2 wherein said means for adjusting the elevation of said platform comprises feet mounted to and extending downwardly from said platform, and said feet being adjustable in length.

5. The device of claim 1 wherein said step is detachably mounted to said trampoline and is selectively movable to a position of use over said spring member and a position of non-use remote from said spring member.

6. The device of claim 5 wherein said step is mounted to said trampoline by said platform being hinged to said frame.

7. The device of claim 5 wherein said step is removably attached to said frame.

8. The device of claim 1 wherein said step is non-movably mounted to said trampoline, and said platform covering only a portion of said spring member whereby a further portion of said spring member is always exposed.

9. The device of claim 1 including a twister mounted to said platform, and said twister including a rotatable disc to permit the user to perform a twisting exercise.

10. The device of claim 1 wherein about one-half of said jumping surface is exposed when said platform is mounted directly over said jumping surface.

11. The device of claim 9 wherein said disc is removably mounted to said platform.

12. The device of claim 9 wherein said platform includes a recess, in its upper surface, said disc being mounted in said recess and said disc having an upper surface which is coplanar with said upper surface of said platform.

13. The device of claim 12 including locking means for selectively locking said disc to prevent rotation of said disc.

14. The device of claim 9 including a pole assembly mounted to said trampoline.

15. The device of claim 14 including resistance means for adjusting the resistance of said poles in opposition to the pivotal movement imparted by the user.

16. The device of claim 15 wherein said pole assembly is detachable from said trampoline.

17. The device of claim 16 wherein said pole assembly is mounted to said frame of said trampoline.

18. The device of claim 1 including a pole assembly mounted to said trampoline.

19. The device of claim 16 including resistance means for adjusting the resistance of said poles in opposition to the pivotal movement imparted by the user from said trampoline.

20. The device of claim 3 wherein said feet include one set of feet fixedly mounted to said frame and at least one further set of feet foldably mounted to said frame.

* * * * *